US010575660B2

(12) United States Patent
Artwohl et al.

(10) Patent No.: US 10,575,660 B2
(45) Date of Patent: Mar. 3, 2020

(54) GLASS ASSEMBLY WITH CLEAR EDGING

(71) Applicant: Anthony, Inc., Sylmar, CA (US)

(72) Inventors: Paul J. Artwohl, Stevensville, MI (US); Pedro Almaguer, North Hills, CA (US); Mark Sandnes, Sylmar, CA (US)

(73) Assignee: Anthony, Inc., Sylmar, CA (US)

( * ) Notice: Subject to any disclaimer, the term of this patent is extended or adjusted under 35 U.S.C. 154(b) by 43 days.

(21) Appl. No.: 15/689,970

(22) Filed: Aug. 29, 2017

(65) Prior Publication Data

US 2019/0059613 A1 Feb. 28, 2019

(51) Int. Cl.

| | |
|---|---|
| ***E06B 3/00*** | (2006.01) |
| ***A47F 3/04*** | (2006.01) |
| ***E05D 3/02*** | (2006.01) |
| ***E05D 5/02*** | (2006.01) |
| ***E05D 5/06*** | (2006.01) |
| ***E05D 7/00*** | (2006.01) |
| ***E05D 11/08*** | (2006.01) |
| ***E06B 3/663*** | (2006.01) |
| ***E06B 3/66*** | (2006.01) |

(Continued)

(52) U.S. Cl.

CPC ..... *A47F 3/0434* (2013.01); *E05D 3/02* (2013.01); *E05D 5/0246* (2013.01); *E05D 5/065* (2013.01); *E05D 7/009* (2013.01); *E05D 11/082* (2013.01); *E06B 3/6612* (2013.01); *E06B 3/66309* (2013.01); *E06B 3/66333* (2013.01); *E06B 3/025* (2013.01); *E06B 3/367* (2013.01); *E06B 3/6715* (2013.01)

(58) Field of Classification Search

CPC ..... A47F 3/0434; E05D 11/082; E05D 3/02; E05D 5/0246; E05D 5/065; E06B 3/025; E06B 3/66333; E06B 3/66309; E06B 3/6612; E06B 3/6715

USPC ..... 49/501, 397, 399, DIG. 1, DIG. 2

See application file for complete search history.

(56) References Cited

U.S. PATENT DOCUMENTS 4,637,167 A * 1/1987 Svensson ..... A47F 3/043 49/386

5,255,473 A * 10/1993 Kaspar ..... A47F 3/043 49/501

(Continued)

OTHER PUBLICATIONS

EP Extended Search Report issued in European Application No. 18187839.8, dated Jan. 18, 2019, 65 pages.

*Primary Examiner* — Jerry E Redman

(74) *Attorney, Agent, or Firm* — Fish & Richardson P.C.

(57) ABSTRACT

One aspect of the invention features a refrigerated display case door that includes a hinge rail, a panel assembly, and a handle. The hinge rail includes a channel portion and a hinge receiving portion. The panel assembly includes two panes of glass bounding a sealed space between the panes, and includes a first edge disposed within the channel portion of the hinge rail. The handle is secured to a surface of the panel assembly proximate a second edge of the panel assembly opposite the first edge. The sealed space is closed by a peripheral seal disposed between the panes along a periphery of the panes. The peripheral seal includes a first material extending along a first portion of the periphery and a second material extending along a second, different portion of the periphery, where the second material is more transparent to visible light than the first material.

20 Claims, 11 Drawing Sheets

(51) Int. Cl.

| | |
|---|---|
| *E06B 3/02* | (2006.01) |
| *E06B 3/67* | (2006.01) |
| *E06B 3/36* | (2006.01) |

(56) References Cited

U.S. PATENT DOCUMENTS

| | | | | |
|---|---|---|---|---|
| 6,052,965 | A * | 4/2000 | Florentin | A47F 3/0434 52/786.13 |
| 6,399,169 | B1 * | 6/2002 | Wang | E06B 3/6612 428/34 |
| 7,929,194 | B2 * | 4/2011 | Legois | B32B 17/10045 359/242 |
| 8,840,007 | B2 * | 9/2014 | Li | B23K 1/0008 228/121 |
| 9,687,087 | B1 * | 6/2017 | Artwohl | A47F 3/0434 |
| 9,751,145 | B2 * | 9/2017 | Li | E06B 3/6612 |
| 10,165,870 | B2 * | 1/2019 | Artwohl | A47F 3/0434 |
| 2006/0005484 | A1 * | 1/2006 | Riblier | A47F 3/0434 52/204.5 |
| 2008/0166570 | A1 * | 7/2008 | Cooper | E06B 3/6612 428/426 |
| 2008/0245011 | A1 * | 10/2008 | Friedl | E06B 3/6612 52/407.5 |
| 2010/0043293 | A1 * | 2/2010 | Nicholson | A47F 3/0434 49/70 |
| 2010/0276473 | A1 * | 11/2010 | Hagen | B23K 1/19 228/121 |
| 2011/0089802 | A1 * | 4/2011 | Cording | A47F 3/0434 312/405 |
| 2014/0162000 | A1 * | 6/2014 | Son | C03C 3/066 428/34 |
| 2014/0335291 | A1 * | 11/2014 | Hasegawa | E06B 3/66 428/34 |
| 2015/0079313 | A1 * | 3/2015 | Vogel-Martin | E06B 3/6612 428/34 |
| 2015/0184446 | A1 * | 7/2015 | Veerasamy | E06B 3/6775 428/34 |
| 2015/0218032 | A1 * | 8/2015 | Hogan | E06B 3/6612 428/34 |
| 2015/0223619 | A1 * | 8/2015 | Artwohl | E06B 3/6612 428/69 |
| 2015/0233174 | A1 * | 8/2015 | Stark | E06B 3/66304 428/69 |
| 2015/0337591 | A1 * | 11/2015 | Koga | E06B 3/66 428/34 |
| 2016/0166085 | A1 * | 6/2016 | Twohy | A47F 3/043 62/248 |
| 2016/0174734 | A1 * | 6/2016 | Artwohl | A47F 3/005 428/34 |
| 2017/0016271 | A1 | 1/2017 | Boucher et al. | |

* cited by examiner

GLASS ASSEMBLY WITH CLEAR EDGING

TECHNICAL FIELD

This invention relates to thermally insulated doors for temperature controlled environments.

BACKGROUND

Refrigerated enclosures are used in commercial, institutional, and residential applications for storing and/or displaying refrigerated or frozen objects. Refrigerated enclosures may be maintained at temperatures above freezing (e.g., a refrigerator) or at temperatures below freezing (e.g., a freezer). Refrigerated enclosures have one or more thermally insulated doors or windows for viewing and accessing refrigerated or frozen objects within a temperature-controlled space. Doors for refrigerated enclosures include thermally insulated glass panel assemblies.

In some circumstances, features of refrigerated enclosure doors that provide improved insulation also reduce the viewable area of the door or affect the aesthetic appearance of the door. For example, opaque thermal sealing materials placed between panes of glass may block a portion of the viewing area of a door.

SUMMARY

One broad aspect of the invention features a refrigerated display case door that includes a hinge rail, a panel assembly, and a handle. The hinge rail includes a channel portion and a hinge receiving portion. The panel assembly includes two panes of glass bounding a sealed space between the panes, and includes a first edge disposed within the channel portion of the hinge rail. The handle is secured to a surface of the panel assembly proximate a second edge of the panel assembly opposite the first edge. The sealed space is closed by a peripheral seal disposed between the panes along a periphery of the panes. The peripheral seal includes a first material extending along a first portion of the periphery and a second material extending along a second, different portion of the periphery, where the second material is more transparent to visible light than the first material. This and other implementations can each optionally include one or more of the following features.

In some implementations, the second material has a higher transmittance of visible light than that of the first material.

In some implementations, the peripheral seal is exposed to the sealed space between the panes.

In some implementations, the first portion of the periphery is along the first edge of the panel assembly. Some implementations include the hinge rail arranged to cover the peripheral seal applied along the first edge.

In some implementations, the first portion of the periphery is along the first edge, a third edge, and a fourth edge of the panel assembly. In some implementations, the second portion of the periphery is along the second edge of the panel assembly.

In some implementations, edge guards are coupled to the second edge and the third edge.

In some implementations, a transparent edge guard is coupled to the second edge. In some implementations, the transparent edge guard has a wiper configured to seal the door when the door is in a closed position.

In some implementations, the sealed space is filled with an insulating gas. In some implementations, the peripheral seal is exposed to the insulating gas within the sealed space.

In some implementations, the sealed space is evacuated below atmospheric pressure. In some implementations, the peripheral seal is exposed to vacuum pressure in the sealed space.

Another aspect of the invention features a refrigerated display case. The refrigerated display case includes a frame, a first display case door, and a second display case door. The first and second display case doors are mounted to the frame. Each display case door includes a hinge rail, a panel assembly, and a handle. The hinge rail includes a channel portion and a hinge receiving portion. The panel assembly includes two panes of glass bounding a sealed space between the panes, and includes a first edge disposed within the channel portion of the hinge rail. The handle is secured to a surface of the panel assembly proximate a second edge of the panel assembly opposite the first edge. The sealed space is closed by a peripheral seal disposed between the panes along a periphery of the panes. The peripheral seal includes a first material extending along a first portion of the periphery and a second material extending along a second, different portion of the periphery, where the second material is more transparent to visible light than the first material. This and other implementations can each optionally include one or more of the following features.

In some implementations, each of the first display case door and the second display case door includes a transparent edge guard coupled to the second edge of the panel assembly. The transparent edge guard can have a wiper extending outward therefrom. The first display case door and the second display case door are arranged within the frame such that, when the doors are closed, the transparent edge guard wipers cooperate with each other to establish a seal between the first display case door and the second display case door.

Another aspect of the invention features a refrigerated display case door. The refrigerated display case door includes a hinge rail, a panel assembly, and a handle. The hinge rail includes a channel portion and a hinge receiving portion. The panel assembly includes two panes of glass bounding a sealed space between the panes, and includes a first edge disposed within the channel portion of the hinge rail. The handle is secured to a surface of the panel assembly proximate a second edge of the panel assembly opposite the first edge. The display case door further includes a handle and edge guards. The handle is secured to a surface of the panel assembly proximate a second edge of the panel assembly opposite the first edge. The edge guards are guards coupled to a top edge and a bottom edge of the panel assembly, and a transparent edge guard coupled to the second edge of the panel assembly. The sealed space is closed by a peripheral seal disposed between the panes along a periphery of the panes. The peripheral seal includes a first material extending along a first portion of the periphery and a second material extending along a second, different portion of the periphery, where the second material is more transparent to visible light than the first material. This and other implementations can each optionally include one or more of the following features.

The concepts described herein may provide several advantages. For example, implementations of the invention may provide a vacuum insulated glass assembly that is less susceptible to thermal stresses. Implementations may prevent or minimize condensation build up on vacuum insulated doors. Implementations provide efficient condensation clearing with high voltage electrical coatings while maintaining consumer safety.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
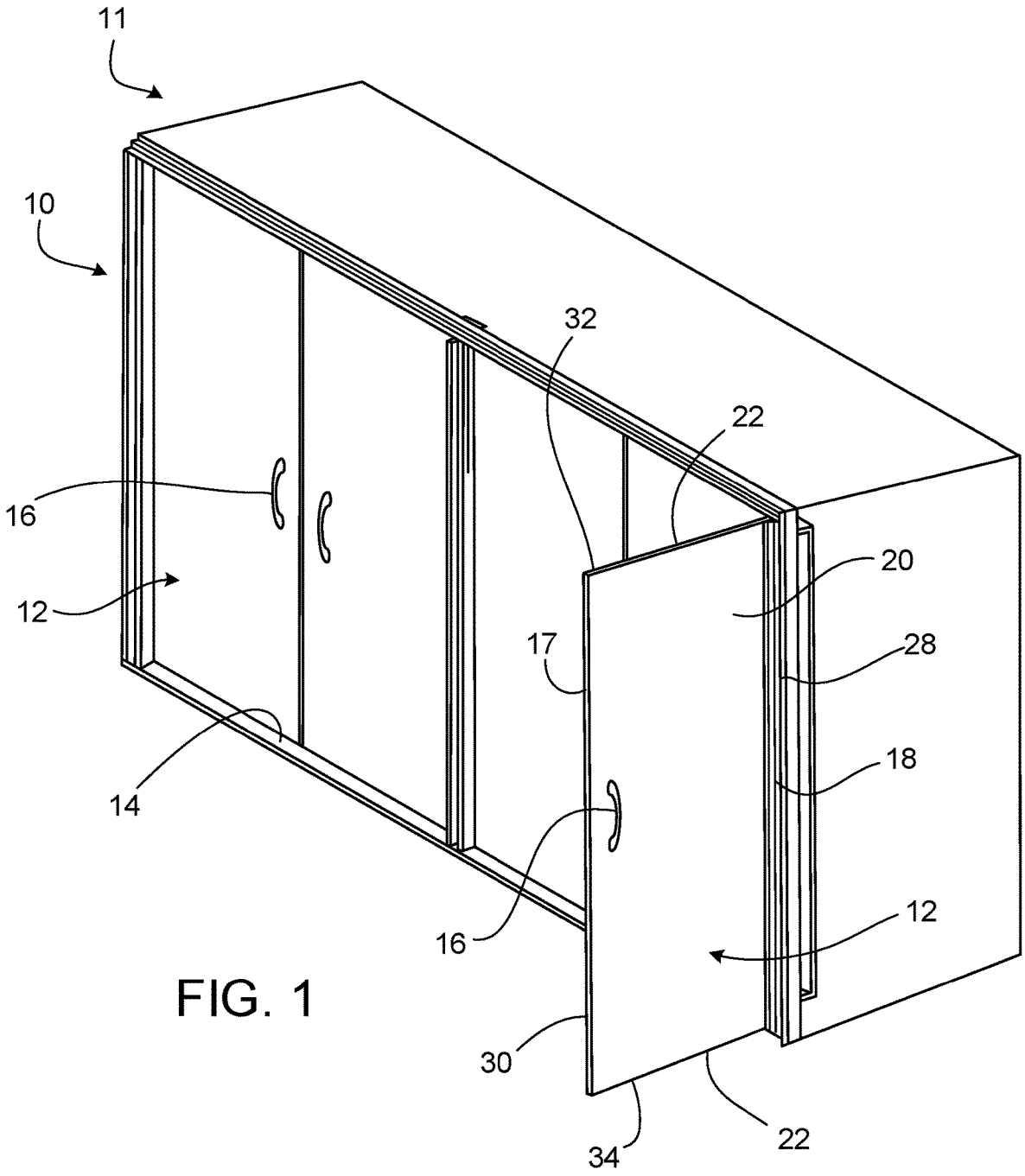
FIG. 1 is a perspective view of a display case door assembly including four display case doors mounted to a display case frame, each door having a transparent panel assembly, according to an exemplary implementation.
Figure 2:
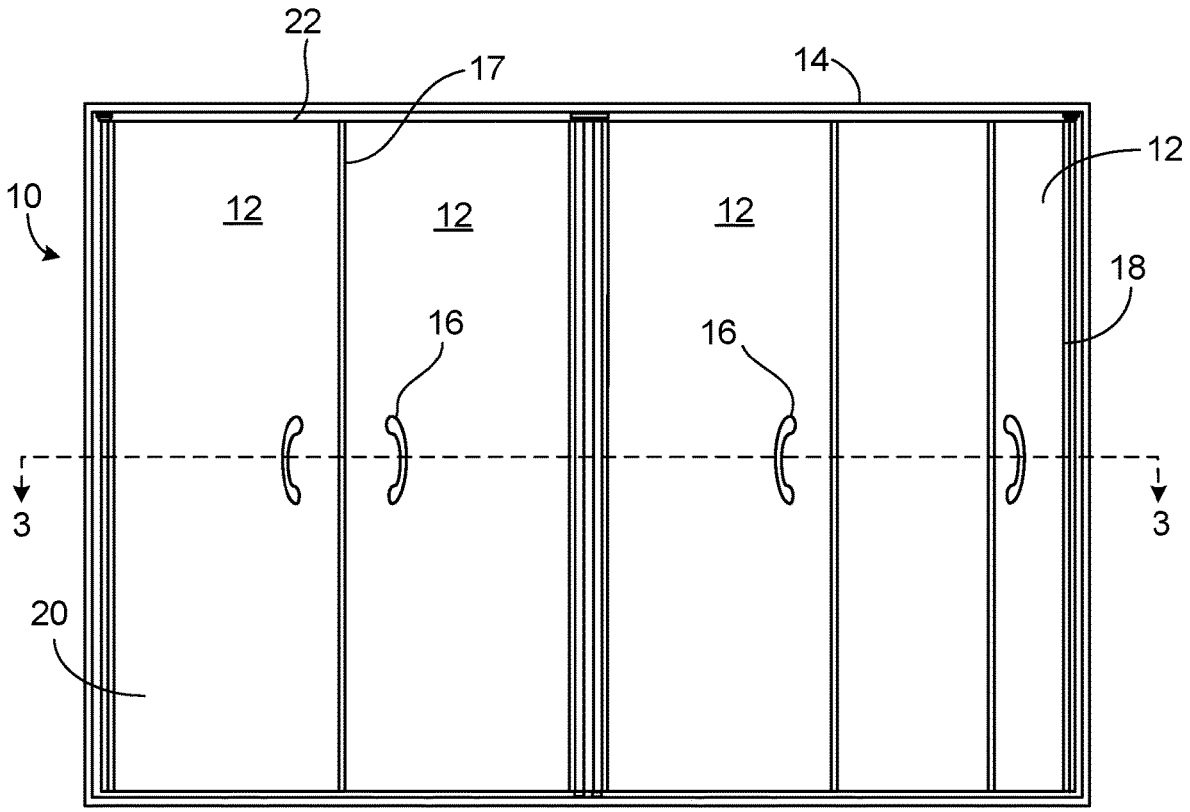
FIG. 2 is a front elevation view of the display case door assembly of FIG. 1, according to an exemplary implementation.
Figure 3:
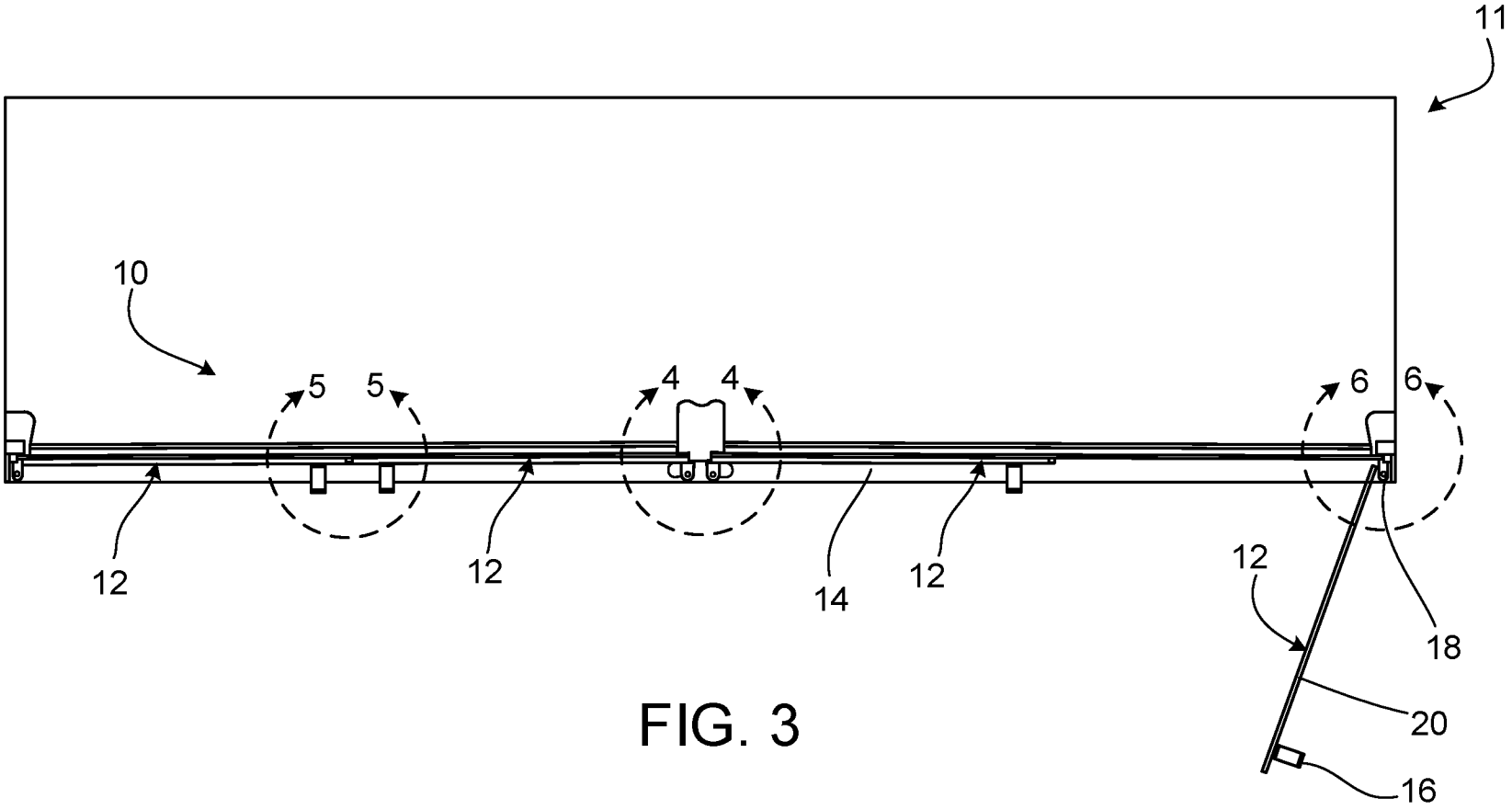
FIG. 3 is a cross-sectional plan view of the display case door assembly of FIG. 1 taken along line 3-3 in FIG. 2, according to an exemplary implementation.

FIGS. 1-3 illustrate an exemplary display case door assembly 10 installed in a refrigerated display case 11. The refrigerated display case 11 may be a refrigerator, freezer, or other enclosure defining a temperature-controlled space. For example, refrigerated display case 11 may be a refrigerated display case or refrigerated merchandiser in grocery stores, supermarkets, convenience stores, florist shops, and/or other commercial settings to store and display temperature-sensitive consumer goods (e.g., food products and the like). Refrigerated display case 11 can be used to display products that must be stored at relatively low temperatures and can include shelves, glass doors, and/or glass walls to permit viewing of the products supported by the shelves. In some implementations, refrigerated display case 11 is a refrigerated display unit used, for example, in warehouses, restaurants, and lounges. For example, refrigerated display case 11 can be a free standing unit or "built in" unit that forms a part of the building in which the refrigerated display case 11 is located.

Display case door assembly 10 includes a plurality of display case doors 12 mounted in a display case frame 14. Each display case door 12 includes a panel assembly 20 pivotally mounted on hinge rail 18. Doors 12 each include a handle 16. In some implementations, doors 12 can be sliding doors configured to open and close by sliding with respect to case frame 14.

As discussed in more detail below, panel assembly 20 includes two panes of glass bounding a sealed space in between, forming a sealed glass unit (SGU). The sealed space is closed by a peripheral seal comprising two materials, one material being more transparent than the other. In some implementations, panel assembly 20 may be used as part of a door assembly configured to provide a thermal insulation effect (e.g., for a refrigerated display case) or otherwise used as any type of transparent or substantially transparent panel that provides a thermal insulation effect (e.g., a sliding or hinged window, a fixed-position window, a revolving or sliding door, a hinged door, etc.). In some implementations, panel assembly 20 may be used as an insulated window or for a display case 11.

Panel assembly 20 includes four edges with a first edge 28 disposed within hinge rail 18. A second edge 30 is opposite to first edge 28, proximate handle 16. A third edge 32 is at a top end of panel assembly 20, and a fourth edge 34 is at a bottom end of panel assembly 20. Edge guards extend across each of the top, bottom and second edges of panel assembly 20. For example, top edge 32 and bottom edge 34 include opaque edge guards 22, and second edge 30 includes a transparent edge guard 17. Edge guards 17 and 22 may be attached to the edges of the panel assembly 20 by a friction fit of an adhesive, or by using mechanical fasteners. For example, in such implementations, hinge rail 18 coupled to edge 28 may support the panel assembly 20 within display case door assembly 10 without the need for a frame along one or more of edges 30, 32, or 34, thereby, enhancing a minimalistic appearance of the display case door assembly 10 and supplementing the aesthetics provided by panel assembly 20, appearing as a single pane of glass. In addition, without door frames, door assembly 10 reduces spare parts inventory, provides lower maintenance costs and less downtime, all while increasing product merchandising visibility Display case door 12 includes a handle 16 secured to a front surface of panel assembly 20, located proximate second edge 30. Handle 16 may be attached to panel assembly 20 by using an adhesive or epoxy. Handle 16 may be used to open, close, lock, unlock, seal, unseal, or otherwise operate display case door 12. Handle 16 can be made from extruded aluminum tubes that are cut to a specified dimension and bonded to a front surface of display case door 12.

Panel assembly 20 includes one or more panes of transparent or substantially transparent glass (e.g., insulated glass, non-tempered glass, tempered glass, etc.), plastics, or other transparent or substantially transparent materials. In some implementations, panel assembly 20 includes multiple layers of transparent panes (e.g. multiple panes per door 12). For example, panel assembly 20 can be a multi-pane unit having a first pane and a second pane that are separated by a gap, forming an SGU.

Figure 4:
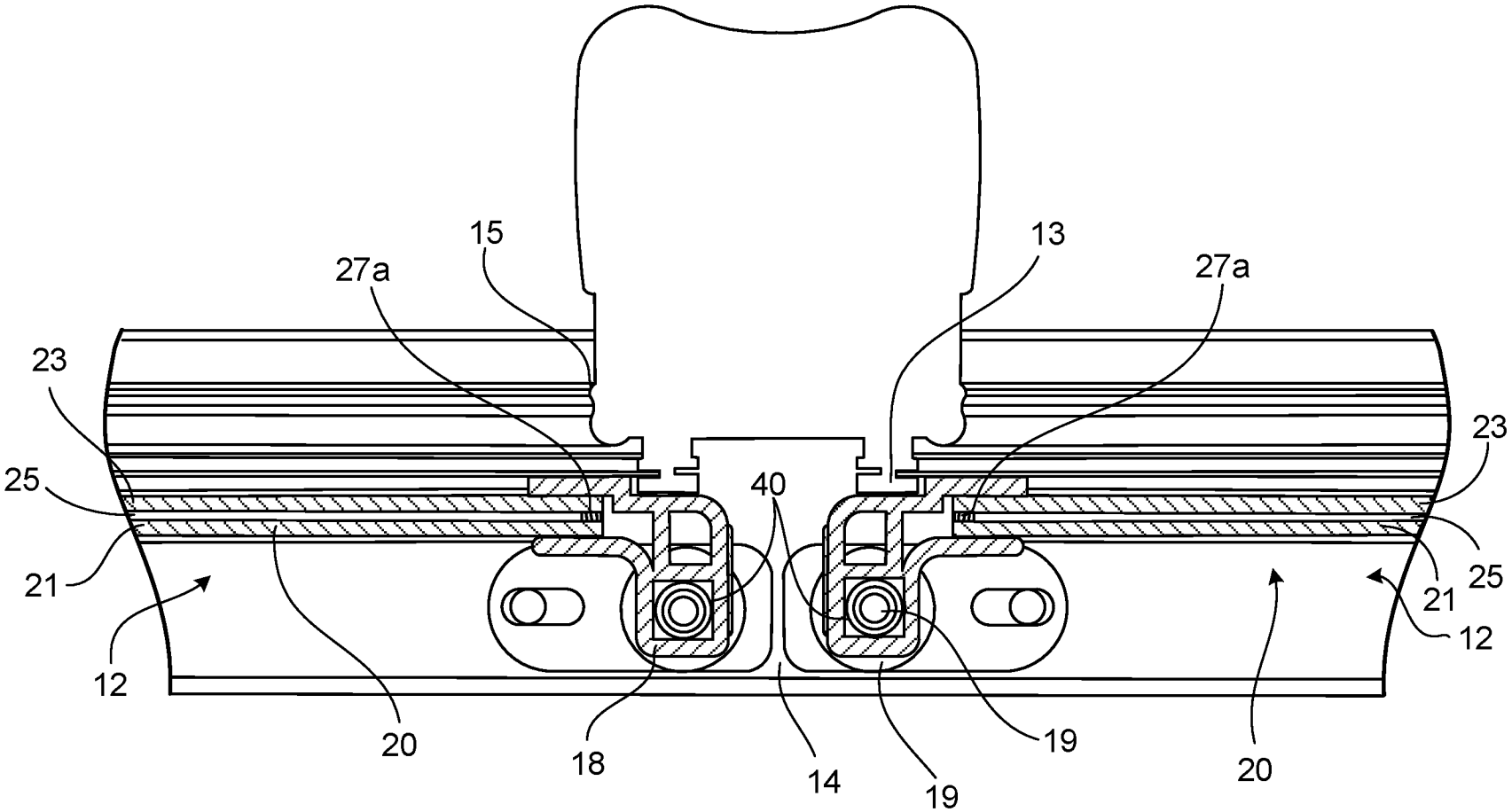
FIG. 4 is a detail view of a portion of the display case door assembly shown in FIG. 3, as indicated.
Figure 5:
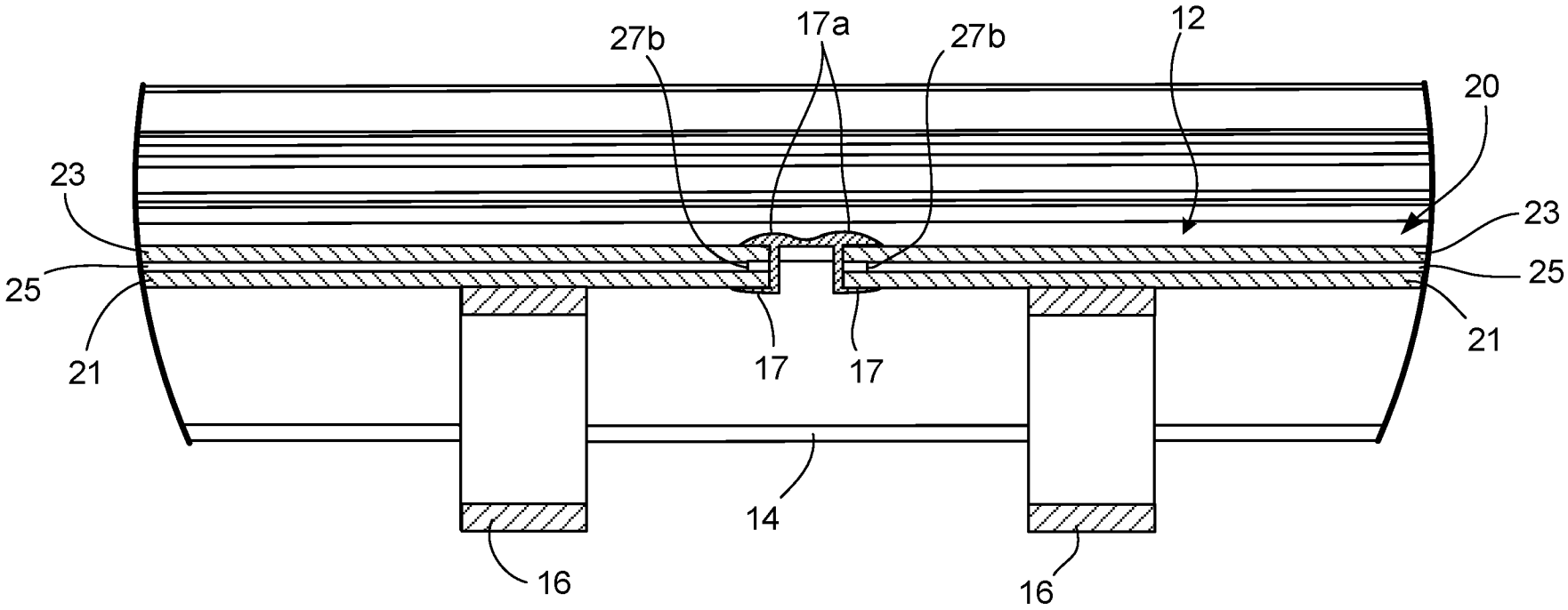
FIG. 5 is a detail view of a portion of the display case door assembly shown in FIG. 3, as indicated.
Figure 6:
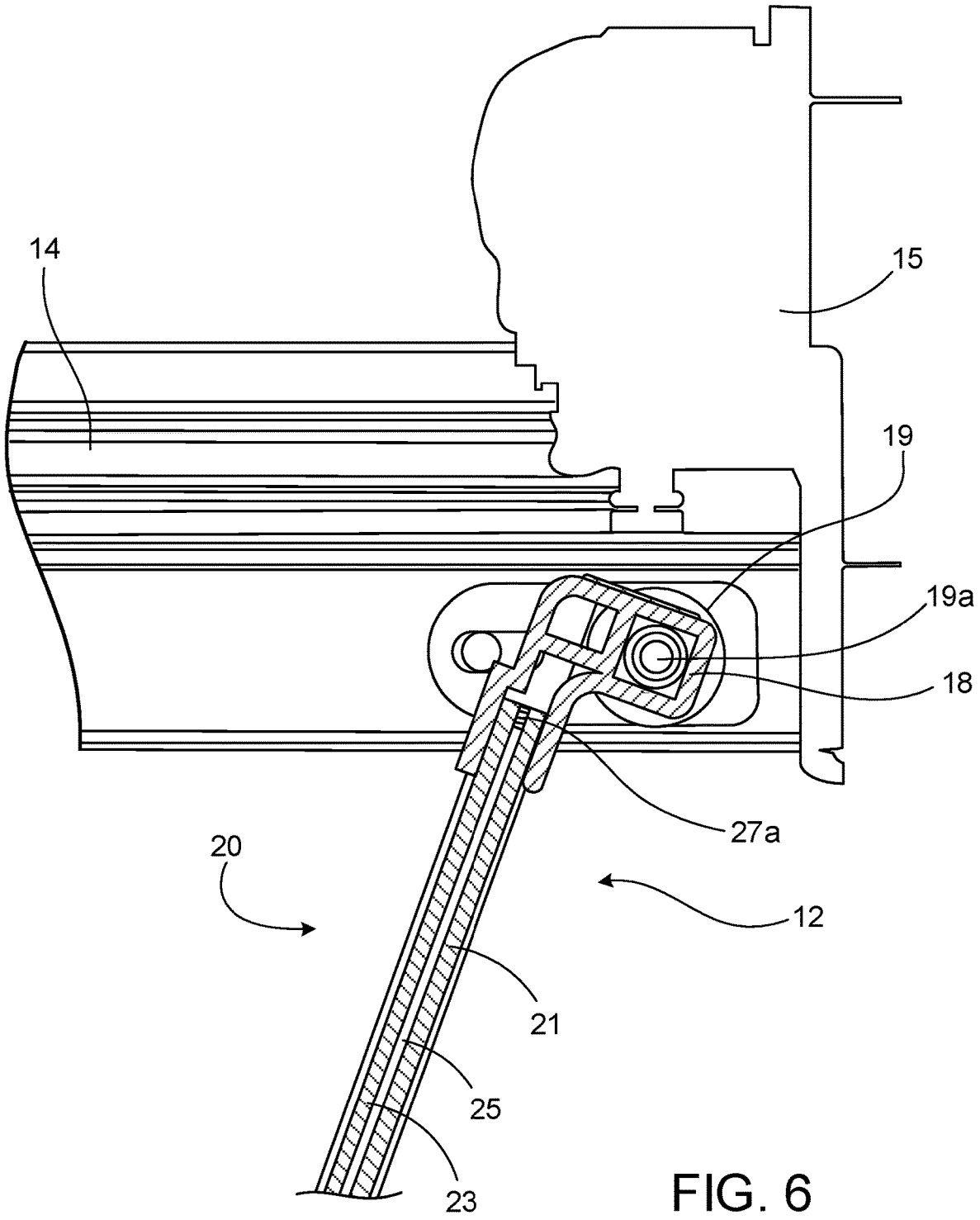
FIG. 6 is a detail view of a portion of the display case door assembly shown in FIG. 3, as indicated.

FIGS. 4-6 illustrate an example implementation of display case door 12. Referring specifically to FIGS. 4 and 6, hinge rail 18 is coupled to panel assembly 20 along the vertical length of panel 20. Hinge rail 18 can be coupled to panel 20 using various methods such as friction fit, using an adhesive, or by using mechanical fasteners. Hinge rail 18 has a hinge channel 40 that includes openings at the top and bottom thereof, as discussed in more detail below with respect to FIG. 10. The openings at the top and bottom of hinge channel 40 receive hinge pins 19*a* of torque hinges 19 for connecting door 12 to frame 14.

In some implementations, hinge rail 18 can be mounted to torque hinges 19. Torque hinges 19 can be configured to apply a torque to door 12 which automatically returns door 12 to a closed position. For example, torque hinges 19 may include internal springs (e.g., torsion springs, linear springs, etc.) which store energy when door 12 is opened and apply a closing torque to door 12 (i.e., a torque which causes door 12 to move toward the closed position). In some implementations, the torque hinges are attached directly to panel assembly 20. In some examples, instead of torque hinges 19, hinge rail 18 can be configured to connect to gravity hinges, electrical hinges, or different types of hinges.

Display case door 12 can also include any of a variety of structures or features for attaching door 12 to frame 14. For example, door 12 may include a structure for housing wiring, a mullion 15, one or more gaskets 13, and/or other associated brackets and components included in refrigerated display cases.

Figure 9:
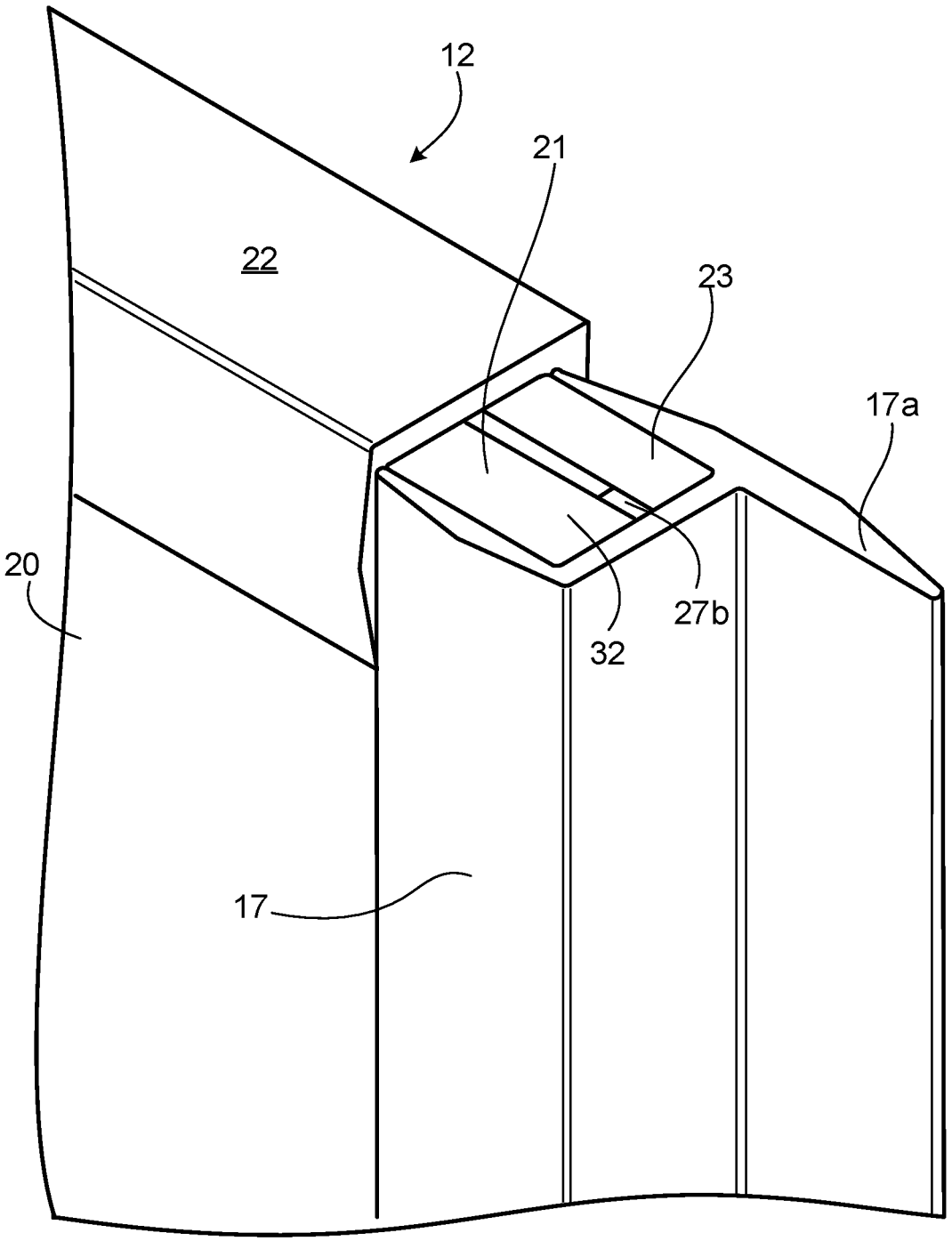
FIG. 9 is a partial perspective view of the display case door assembly of FIG. 1, showing a transparent edge guard according to implementations of the present disclosure.

Referring to FIGS. 5 and 9, display case door 12 can include edge guards 17 and 22 coupled to edges of panel assembly 20. An edge guard coupled to an edge proximate the handle can be clear/transparent. Edge guards coupled to a top and bottom edges can be opaque. Transparent edge guards transmit more light than opaque edge guards. Second edge 30 (e.g. handle-side edge) includes transparent seal 27*b* as further discussed in FIG. 7. Transparent seal 27*b* combined with transparent edge guard 17 improves product visibility and aesthetic appearance. Edge guards 17 and 22 have open channels (e.g., U-shaped or C-shaped channels) configured to fit over an edge of panel 20. Edge guards 17 and 22 can be coupled to panel 20 by using silicon or the like for bonding, providing a sealing feature. In some implementations, clear edge guard 17 on second edge 30 includes a wiper 17*a* that cooperates with a corresponding wiper 17*a* on an opposite oriented door (as shown in FIG. 5) to seal refrigerated display case 11 when doors 12 are closed. In one example, top edge 32 and bottom edge 34 can include opaque edge guards 22, while second edge 30 includes transparent edge guard 17. Alternatively, edge guards may be coupled only to the third edge (top edge) 32 and second edge (handle-side edge) 30.

Figure 7:
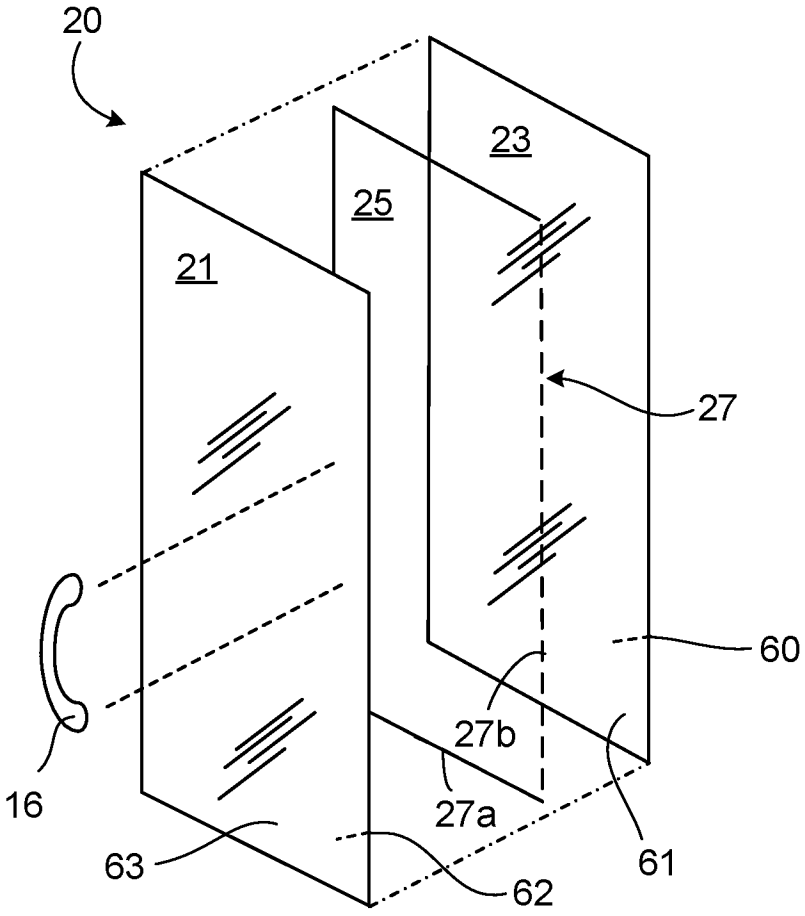
FIG. 7 is an exploded view of the exemplary panel assembly shown in FIG. 1.

Referring now to FIG. 7, panel assembly 20 includes a front pane 21, a peripheral seal 27, and a rear pane 23. Front pane 21 has an outside surface 63 (e.g., also the outside surface of the panel assembly 20) and an inside surface 62. For example, outside surface 63 faces toward a consumer standing in front of the display case when door 12 is closed. Inside surface 62 faces toward merchandise within the display case when door 12 is closed. Rear pane 23 has a first surface 61 and a second surface 60 (e.g., which also serves as the inside surface of the panel assembly 20). For example, first surface 61 faces toward a consumer standing in front of the display case when door 12 is closed. Second surface 60 faces toward merchandise within the display case when door 12 is closed.

Front pane 21 and rear pane 23 are assembled together to form an SGU panel assembly. Together, front pane 21 and rear pane 23 bound a sealed space 25 between the panes 21 and 23. Sealed space 25 is closed by peripheral seal 27. Peripheral seal 27 is disposed between panes 21 and 23 along a periphery of the panes, such that peripheral seal 27 is exposed to sealed space 25 between panes 21 and 23. Accordingly, inside surface 62 of front pane 21 is separated from the first surface 61 of second pane 23 by sealed space 25.

In some implementations, sealed space 25 can be filled with an insulating gas such as a noble gas (e.g., Argon, Krypton, etc.) which functions as a thermal insulator to reduce heat transfer through the panel. Alternatively, sealed space 25 can be an evacuated space below atmospheric pressure. For example, panel assembly 20 can be a vacuum insulated glass (VIG) assembly that has a vacuum port (not shown) for the panel to be evacuated. The vacuum port can be used to remove air from sealed space 25 after panel assembly 20 has been assembled in order to draw a vacuum within sealed space 25. The vacuum port may extend through either pane 21 or pane 23.

Peripheral seal 27 includes two different materials: an opaque material 27*a*, and a transparent material 27*b*. The transparent material 27*b* has a higher transmittance of visible light than that of the opaque material 27*b*. The opaque material 27*a* can include silicone resin, as well as polyisobutylene, polysulfide, glass solder, ceramic frit, or a mixture of these various compounds. These compounds create an effective moisture barrier, provide good thermal insulation, and are relatively inexpensive. However, despite these advantages, opaque material 27*a* is unattractive and in some instances requires to be masked by a door frame. Transparent material 27*b* can include a transparent resin such as a glue with silicone, a hybrid mastic having silicone and/or polyurethane, hot-melt adhesive, or a mixture of these various compounds. These compounds are aesthetically attractive, and increase the product merchandising visibility. However, transparent material 27*b* may be more expensive and is generally less effective thermal insulator and moisture barrier than opaque material 27*a*.

In other implementations, peripheral seal 27 can be made of an inorganic material capable of providing a hermetic seal. In some implementations, peripheral seal 27 is made of an alloy material specifically formulated for joining glass, silicon, and other types of silicates. For example, peripheral seal 27 can be made of a metallic alloy or an active solder including, but not limited to, tin, silver, and titanium. In some implementations, peripheral seal 27 is formed using the "S-BOND® 220M" alloy manufactured by S-Bond Technologies, LLC. In some implementations, peripheral seal 27 is a ceramic frit made from a granulated or powdered ceramic or glass material. The ceramic frit may be a ceramic composition that has been fused in a fusing oven, quenched to form a glass, and granulated.

Figure 8A:
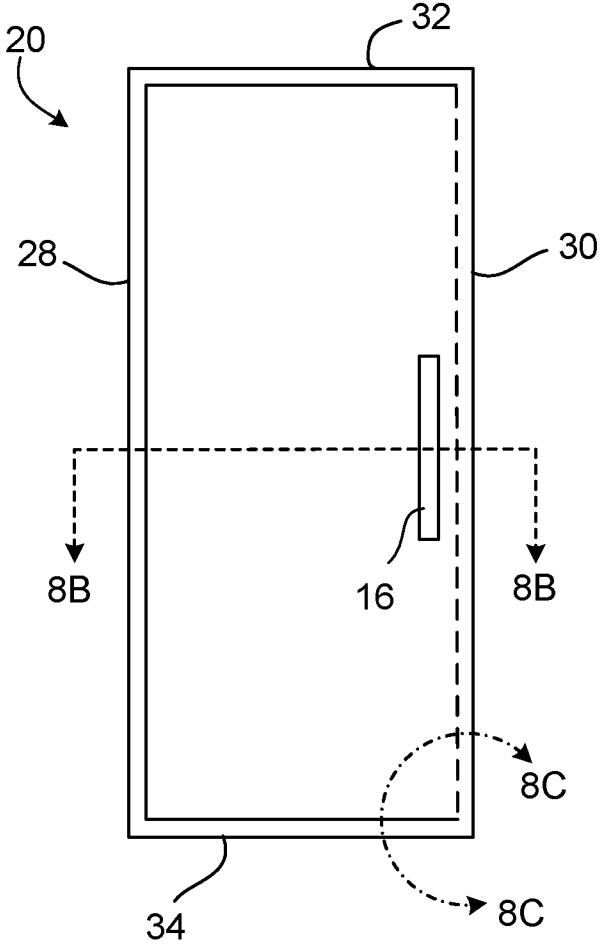
FIG. 8A is a front elevation view of the panel assembly shown in FIG. 7.
Figure 8B:
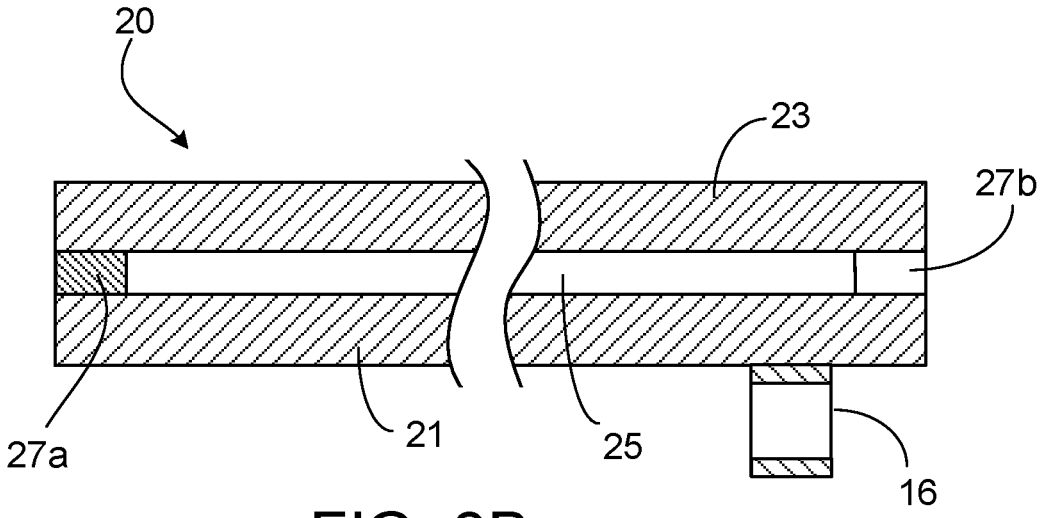
FIG. 8B is a side cross-sectional plan view of the panel assembly shown in FIG. 8A, taken along line 8B-8B in FIG. 8A.
Figure 8C:
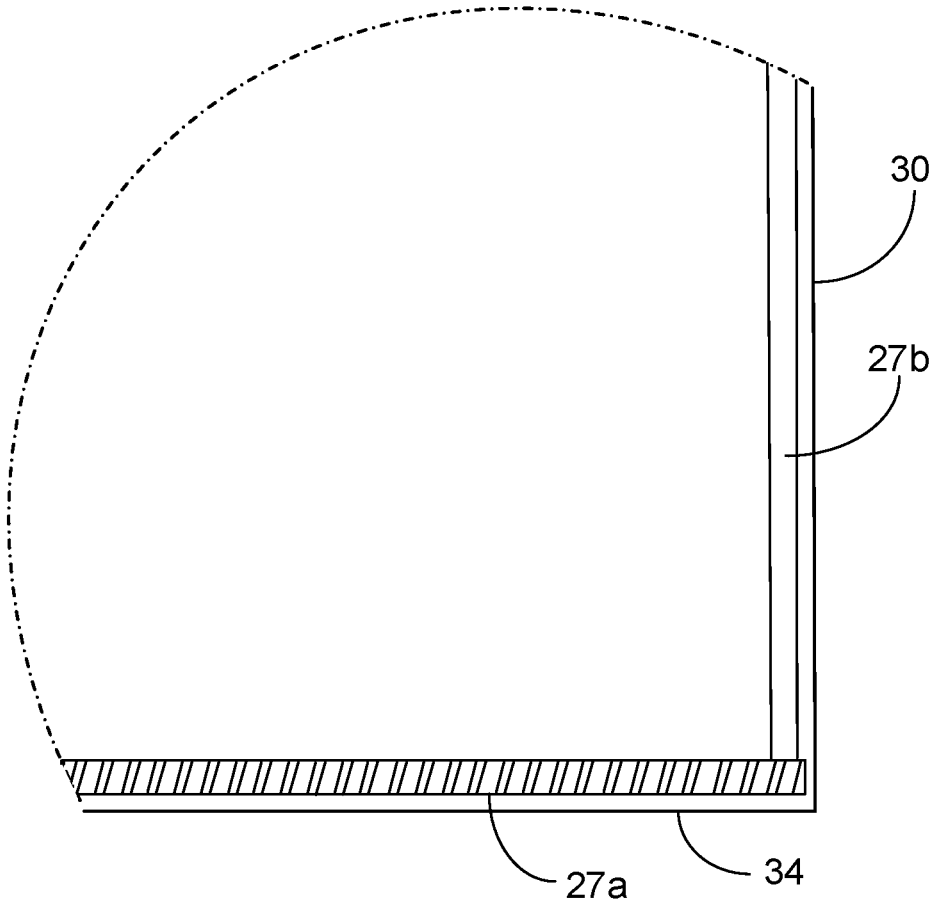
FIG. 8C is a detail view of a portion of the panel assembly shown in FIG. 8A.

Referring to FIGS. 8A-C, opaque material 27*a* (e.g. opaque seal) extends along a first portion of the periphery of panel assembly 20 (as indicated by a dashed line), and transparent material 27*b* (e.g. transparent seal) extends along a second, different portion of the periphery (as indicated by a solid line). The first portion of the periphery includes top edge 32, bottom edge 34, and first edge 28 (e.g. hinge rail edge) of panel assembly 20, while the second portion of the periphery includes second edge 30, proximate handle 16. Because first edge 28 is configured to couple to hinge rail 18, opaque seal 27*a* along first edge 28 is covered by hinge rail 18 during display, and thus not visible to a consumer. In addition, because top edge 32 and bottom edge 34 are adjacent case frame 14 during display when door 12 is closed, opaque seal 27*a* along the top and bottom edges may be less visible to a consumer. The configuration of panel assembly 20 illustrated in FIGS. 8A-8C improves the benefits of using opaque seal 27*a*, by using opaque seal 27*a* along a majority of the edges of panel assembly 20 without obstructing the product view. In addition, because second edge 30 is the most visible edge to consumers, it is an advantage of this implementation to have transparent seal 27*b* be disposed along second edge 30. Transparent material 27*b* may create the impression that refrigerated display case 11 lacks a seal along second edge 30, offering a less obstructed visibility. Another advantage of this implementation is that the amount of transparent seal 27*b* is reduced (in contrast with doors having transparent seal along more edges) to increase insulation of panel assembly 20, while increasing the product visibility and aesthetic appearance of panel assembly 20.

In some implementations, the first portion of the periphery may include only first edge 28 of panel assembly 20, such that the opaque seal is only along first edge 28. In some implementations, the transparent sealing material can be applied at the top and bottom edges of the assembly as well as at the second edge of the assembly. Alternatively, the transparent seal 27*b* can be disposed only along second edge 30 and top edge 32, or only along second edge 30 and bottom edge 34. In addition, an opaque edge guard can cover an edge with opaque sealing materials and a transparent edge guard can cover an edge with transparent sealing materials.

In some implementations, edge guards are coupled to second edge 30 and third edge 32, where a transparent edge guard is coupled to second edge 30. In some implementations, the transparent edge guard has a wiper configured to seal the door when the door is in a closed position.

Referring also to FIG. 7, in some implementations, peripheral seal 27 is exposed to sealed space 25 between the panes. In some implementations, sealed space 25 is filled with an insulating gas, where the peripheral seal 27 is exposed to the insulating gas within sealed space 25. In some implementations, sealed space 25 is evacuated below atmospheric pressure, where peripheral seal 27 is exposed to vacuum pressure in the sealed space.

In some implementations, front pane 21 and rear pane 23 are made of tempered glass. For example, using tempered glass may improve the durability of panes 21 and 23 relative to non-tempered glass. Using tempered glass may also improve the safety of the panel assembly 20 by causing panes 21 and 23 to fracture into many small pieces in the event that breakage occurs.

Figure 10:
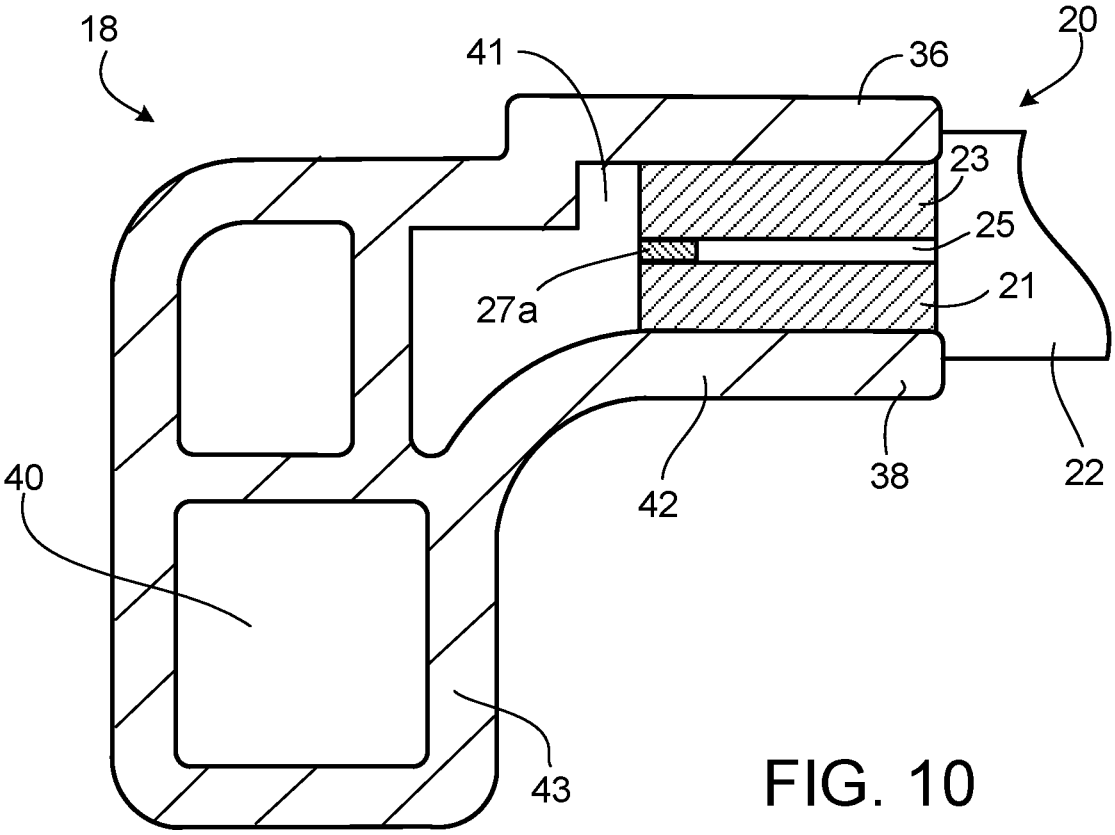
FIG. 10 is a cross-sectional plan view of the rail of the display case door assembly of FIG. 1, according to the present disclosure.
Figure 11:
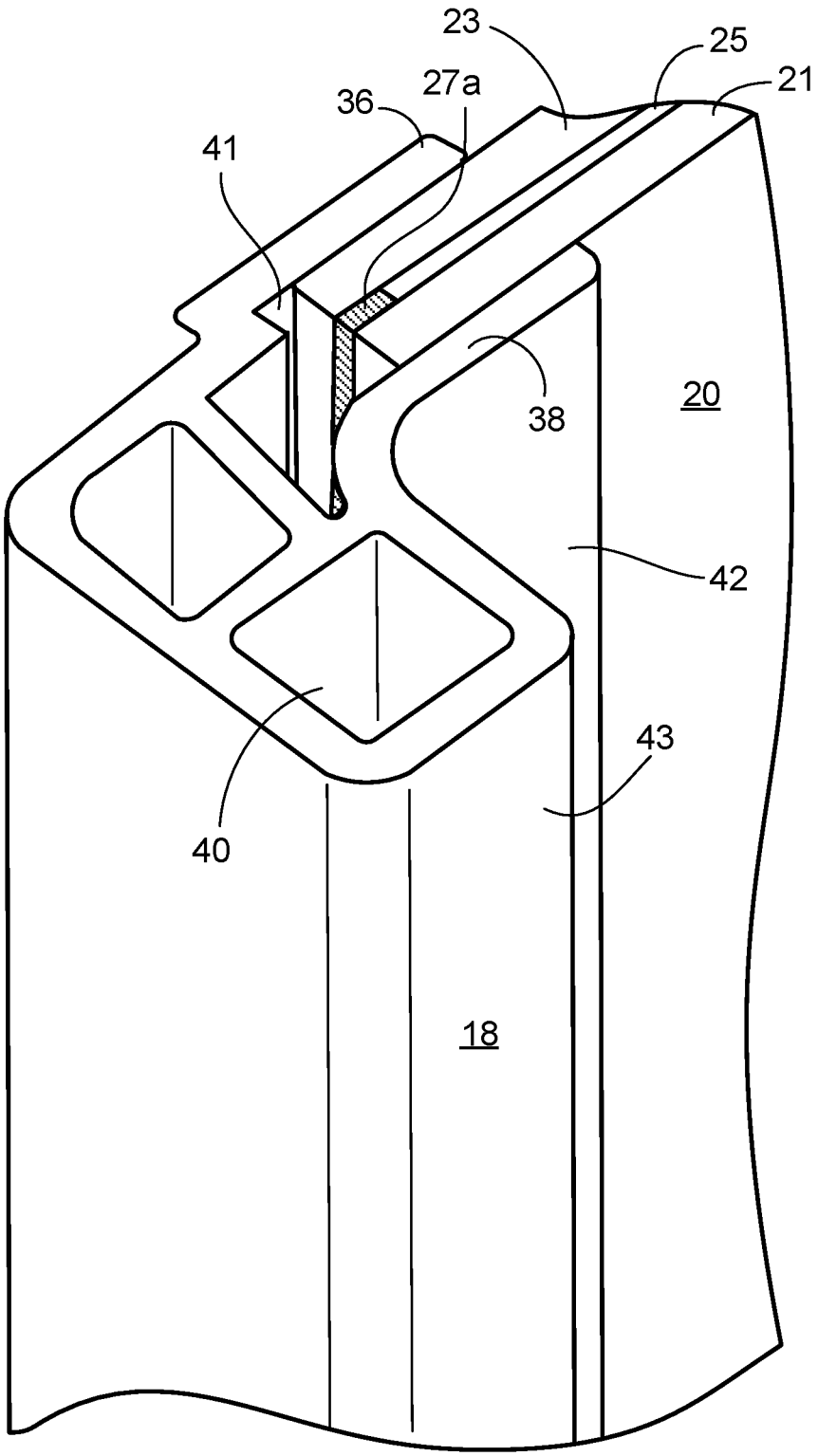
FIG. 11 is a cross-sectional perspective view of the rail of the display case door assembly of FIG. 1, according to the present disclosure.

Referring to FIGS. 10 and 11, hinge rail 18 has an "L" shaped cross-section when viewed from the top or bottom of door 12. The "L" shape is shown to include a hinge receiving portion 43 and a channel portion 42. Channel portion 42 includes opposing members 36 and 38 that define a panel channel 41 for receiving and securing panel 20. More specifically, channel portion 42 is configured to receive first edge 28 of panel assembly 20, covering opaque seal 27*a* of first edge 28. Hinge channel 40 is configured to attach to hinge 19. Hinge channel 40 has room for receiving cables, or other electrical or mechanical equipment in implementations where panel 20 is configured to connect to such components. In one example, rail 18 is an aluminum extrusion into which panel 20 is bonded (e.g., using an adhesive such as epoxy or polyurethane). A tape that incorporates an adhesive, such as acrylic or the like may also be used. In other embodiments, a mechanical clamp could be used to secure panel 20 in place. Combinations of a clamp and adhesives or tape could also be used. None of these are a limitation on the present invention. In other embodiments, rail 18 can be made of another material, such as stainless steel.

The elements and assemblies discussed herein may be constructed from any of a wide variety of materials that provide sufficient strength or durability, in any of a wide variety of colors, textures, and combinations. Further, elements shown as integrally formed may be constructed of multiple parts or elements.

As used herein, the terms "generally," "substantially," and similar terms are intended to have a meaning consistent with the common and accepted usage by those of ordinary skill in the art to which the subject matter of this disclosure pertains. For example, the use of such terms indicates values or measurements that are within acceptable engineering, machining, or measurement tolerances within the art. Accordingly, these terms should be interpreted as indicating that insubstantial or inconsequential modifications or alterations of the subject matter described and claimed are considered to be within the scope of the invention as recited in the claims.

It should be noted that the orientation of various elements may differ according to other exemplary implementations, and that such variations are intended to be encompassed by the present disclosure.

While a number of examples have been described for illustration purposes, the foregoing description is not intended to limit the scope of the invention, which is defined by the scope of the appended claims.

What is claimed is:

1. A refrigerated display case door, comprising:

a hinge rail comprising a channel portion and a hinge receiving portion;

a panel assembly comprising two panes of glass bounding a sealed space between the panes, the panel assembly having a first vertical edge disposed within the channel portion of the hinge rail; and a handle secured to a surface of the panel assembly proximate a second vertical edge of the panel assembly opposite the first vertical edge;

wherein the sealed space is closed by a peripheral seal disposed between the panes around a periphery of the panes, the peripheral seal comprising a first section extending continuously along a first portion of the periphery and a second section extending continuously along a second, different portion of the periphery, wherein the first portion of the periphery includes the first vertical edge of the panel assembly and the second portion of the periphery includes the second vertical edge, and wherein the second section is more transparent to visible light than the first section.

2. The door of claim 1, wherein the second section has a higher transmittance of visible light than that of the first section.

3. The door of claim 1, wherein the peripheral seal is exposed to the sealed space between the panes.

4. The door of claim 1, wherein the hinge rail is arranged to cover the peripheral seal applied along the first vertical edge.

5. The door of claim 1, wherein the first portion of the periphery is along the vertical first edge, a third edge, and a fourth edge of the panel assembly.

6. The door of claim 1, wherein edge guards are coupled to the second vertical edge and a third edge.

7. The door of claim 1, wherein a transparent edge guard is coupled to the second vertical edge.

8. The door of claim 7, wherein the transparent edge guard comprises a wiper configured to seal the door when the door is in a closed position.

9. The door of claim 1, wherein the sealed space is filled with an insulating gas.

10. The door of claim 9, wherein the peripheral seal is exposed to the insulating gas within the sealed space.

11. The door of claim 1, wherein the sealed space is evacuated below atmospheric pressure.

12. The door of claim 11, wherein the peripheral seal is exposed to vacuum pressure in the sealed space.

13. The door of claim 1, wherein the first section of the peripheral seal is opaque.

14. A refrigerated display case comprising:

a frame; and a first display case door and a second display case door mounted to the frame, each of the first display case door and the second display case door comprising:

a hinge rail comprising a channel portion and a hinge receiving portion;

a panel assembly comprising two panes of glass bounding a sealed space between the panes, the panel assembly having a first vertical edge disposed within the channel portion of the hinge rail; and a handle secured to a surface of the panel assembly proximate a second vertical edge of the panel assembly opposite the first edge;

wherein the sealed space is closed by a peripheral seal disposed between the panes around a periphery of the panes, the peripheral seal comprising a first section extending continuously along a first portion of the periphery and a second section extending continuously along a second, different portion of the periphery, wherein the first portion of the periphery includes the first vertical edge of the panel assembly and the second portion of the periphery includes the second vertical edge, and wherein the second section is more transparent to visible light than the first section.

15. The refrigerated display case of claim 14, wherein the second section has a higher transmittance of visible light than that of the first section.

16. The refrigerated display case of claim 14, wherein each of the first display case door and the second display case door comprise a transparent edge guard coupled to the second vertical edge of the panel assembly, the transparent edge guard having a wiper extending outward therefrom, and wherein the first display case door and the second display case door are arranged within the frame such that, when closed, the transparent edge guard wipers cooperate with each other to establish a seal between the first display case door and the second display case door.

17. The door of claim 14, wherein the first section of the peripheral seal is opaque.

18. A refrigerated display case door, comprising:

a hinge rail comprising a channel portion and a hinge receiving portion;

a panel assembly comprising two panes of glass bounding a sealed space between the panes, the panel assembly having a first vertical edge disposed within the channel portion of the hinge rail;

a handle secured to a surface of the panel assembly proximate a second vertical edge of the panel assembly opposite the first vertical edge;

edge guards coupled to a top edge and a bottom edge of the panel assembly; and a transparent edge guard coupled to the second vertical edge of the panel assembly, wherein the sealed space is closed by a peripheral seal disposed between the panes around a periphery of the panes, the peripheral seal comprising a first section and a second section, the first section extending continuously along the first vertical edge, the top edge, and the bottom edge of the panel assembly, the second section extending continuously along the second vertical edge of the panel assembly, and wherein the second section is more transparent to visible light than the first section.

19. The door of claim 18, wherein the second section has a higher transmittance of visible light than that of the first section.

20. The door of claim 18, wherein the first section of the peripheral seal is opaque.

* * * * *